US011298581B2

(12) United States Patent
Hoebel

(10) Patent No.: US 11,298,581 B2
(45) Date of Patent: Apr. 12, 2022

(54) THERAPEUTIC WALKING TRAINER

(71) Applicant: medica Medizintechnik GmbH, Hochdorf (DE)

(72) Inventor: Otto Hoebel, Hochdorf (DE)

(73) Assignee: medica Medizintechnik GmbH, Hochdorf (DE)

( * ) Notice: Subject to any disclaimer, the term of this patent is extended or adjusted under 35 U.S.C. 154(b) by 81 days.

(21) Appl. No.: 16/741,420

(22) Filed: Jan. 13, 2020

(65) Prior Publication Data

US 2020/0147444 A1 May 14, 2020

Related U.S. Application Data

(63) Continuation of application No. PCT/EP2017/067691, filed on Jul. 13, 2017.

(51) Int. Cl.
*A63B 21/00* (2006.01)
*A61H 1/02* (2006.01)
(Continued)

(52) U.S. Cl.
CPC ..... *A63B 21/4015* (2015.10); *A61H 1/0266* (2013.01); *A63B 21/00178* (2013.01);
(Continued)

(58) Field of Classification Search
CPC ..... A61H 1/0266; A61H 3/008; A61H 2201/1621; A61H 2201/1676; A61H 2201/165; A61H 2201/1642; A61H 2201/1652; A63B 21/00178; A63B 21/4015; A63B 21/4034; A63B 21/00181; A63B 21/4033; A63B 21/4045; A63B 23/0464; A63B 23/085; A63B 23/035; A63B 23/03516; A63B 23/03541;
(Continued)

(56) References Cited

U.S. PATENT DOCUMENTS 4,733,858 A * 3/1988 Lan ..... A63B 23/1209 482/113
5,035,421 A * 7/1991 Scheller ..... A63B 21/023 482/79
(Continued)

FOREIGN PATENT DOCUMENTS

DE 197 25 973 A1 12/1998
DE 10 2008 007 580 A1 8/2009
(Continued)

OTHER PUBLICATIONS

International Search Report dated Mar. 23, 2018 in corresponding application PCT/EP2017/067691.

*Primary Examiner* — Megan Anderson
(74) *Attorney, Agent, or Firm* — Muncy, Geissler, Olds & Lowe, P.C.

(57) ABSTRACT

A therapeutic walking trainer with a foot receiving portion for receiving at least a sub-region the forefoot of a user or for forming a connection with a toe of a shoe, having at least one main carrier which can be displaced in and/or counter to an adjustment direction, and with an actively and/or passively operable adjustment unit for the relative adjustment, oriented essentially perpendicular to the adjustment direction, of the foot receiving portion relative to the at least one main carrier.

12 Claims, 11 Drawing Sheets

(51) Int. Cl.

| | |
|---|---|
| ***A63B 23/04*** | (2006.01) |
| ***A63B 23/08*** | (2006.01) |
| *A61H 3/00* | (2006.01) |

(52) U.S. Cl.
CPC ..... *A63B 21/4034* (2015.10); *A63B 21/4045* (2015.10); *A63B 23/0464* (2013.01); *A63B 23/085* (2013.01); *A61H 3/008* (2013.01); *A61H 2201/165* (2013.01); *A61H 2201/1621* (2013.01); *A61H 2201/1642* (2013.01); *A61H 2201/1652* (2013.01); *A61H 2201/1676* (2013.01); *A63B 21/00181* (2013.01)

(58) Field of Classification Search
CPC . A63B 23/04; A63B 23/0405; A63B 23/0417; A63B 23/0429
See application file for complete search history.

(56) References Cited

U.S. PATENT DOCUMENTS

| | | | | |
|---|---|---|---|---|
| 6,514,180 | B1 * | 2/2003 | Rawls | A63B 21/005 482/51 |
| 6,780,142 | B1 * | 8/2004 | Takizawa | A61H 1/0259 482/70 |
| 10,537,150 | B2 * | 1/2020 | Bruel | A63B 21/008 |
| 10,894,182 | B2 * | 1/2021 | Yoon | A63B 71/0054 |
| 2019/0224519 | A1 * | 7/2019 | Regular | A63B 21/0622 |
| 2020/0353308 | A1 * | 11/2020 | Kim | A63B 69/0062 |

FOREIGN PATENT DOCUMENTS

| | | |
|---|---|---|
| JP | 3009889 | 2/2000 |
| JP | 2004-337275 A | 12/2002 |
| WO | WO 2009/035176 A1 | 3/2009 |

* cited by examiner

THERAPEUTIC WALKING TRAINER

This nonprovisional application is a continuation of International Application No. PCT/EP2017/067691, which was filed on Jul. 13, 2017, and which is herein incorporated by reference.

BACKGROUND OF THE INVENTION

Field of the Invention

The present invention relates to a therapeutic walking trainer. Such walking trainers are designed to help patients who have had surgery on their hips or who have had a stroke to learn how to walk naturally again.

Description of the Background Art

The natural gait cycle is formed of a standing leg phase and a swinging leg phase. A gait cycle begins and ends when the heel touches the ground. The standing leg phase comprises three sub-phases: a touching down or landing phase, a standing phase and a push-off phase. The swinging leg phase is divided into an early swinging leg phase, in which the foot leaves the floor and the lower leg swings rearwards and upwards up to an approximately 60 to 80 degree flexion in the knee joint. In the subsequent middle swinging leg phase, the leg is brought forward in a bent position with a knee flexion of 60 to 80 degrees. In the final phase of the swinging leg, the foot is again lowered toward the floor or in the direction of a walking surface with the heel being the first to set down again.

Stroke patients are usually able to initiate the swinging leg phase. Often, however, their own actions are not (yet) sufficient to carry out all sub-phases of the swinging leg phase.

SUMMARY OF THE INVENTION

It is therefore an object of the present invention to provide the user with a therapeutic walking trainer that supports the (re) learning of a natural gait cycle.

For this purpose, there is in particular a foot receiving portion for receiving at least a sub-region the forefoot of a user or for forming a connection with a toe of a shoe, with at least one main carrier that can be displaced in and/or counter to an adjustment direction, and with an actively and/or passively operated adjustment unit for the relative adjustment, oriented substantially perpendicular to the adjustment direction of said foot receiving portion relative to the at least one main carrier.

This has the advantage of supporting users who have difficulty moving the bent leg forward in the swinging leg phase. In this phase, the therapeutic walking trainer takes on a facilitating role by adjusting or moving in and/or counter to the direction of adjustment. To allow the foot of the user to roll naturally during the standing leg phase it has proven useful when a free space is formed in or on the main carrier and if the free space is configured such that a surface area or a walking surface can be tread on by at least a part of the user's foot. In a mobile version, this surface area or walking surface can, for example, be the floor or, in a stationary version, also the (endless) belt of a treadmill. Therefore, the therapeutic walking trainer is also stationary operable, wherein even then the main carrier does not need to move through the space, but instead a movement of the walking trainer is carried out relative to the treadmill surface.

According to an exemplary embodiment of a stationary version of the therapeutic walking trainer, the main carrier has a tread surface which is adapted so as to be tread on by the user's foot or the shoe. The dimension of this tread surface is selected such that a human foot can preferably stand on it flat without projecting beyond the surface area of the main carrier.

The main carrier can be assigned a drive for the motorized adjustment or moving of the main carrier in and/or counter to the adjustment direction. Thus, the forward movement of the user, in particular of the swinging leg, is supported by a motor. This motor can be an electric motor which is supplied by a battery or another energy source.

Alternatively, or additionally, a traction element or a pressure element is provided. Possible traction elements are a rope, a cord, a chain or the like. A possible pressure element is a, preferably rigid, push rod. The traction element or the pressure element can be operated by a therapist during exercise, wherein the traction element or the pressure element support the user's or patient's swinging leg phase. In order for the foot positioned in the walking trainer to follow through in the swinging leg phase, the therapist pulls or pushes the walking trainer forward, with the traction element in the adjustment direction, until the patient's heel again touches down on the walking surface.

The traction element or the pressure element is coupled or can be coupled to the main carrier, as a result of which the main carrier can be pushed, pulled or pressed in and/or counter to the adjustment direction. This ensures that the traction element can engage at or below the center of gravity of the therapeutic walking trainer in order to avoid tipping.

The traction element or the pressure element is coupled or can be coupled to the supporting carrier such that the main carrier can be pushed, pulled or pressed by actuating the supporting carrier in and/or counter to the adjustment direction by means of the traction element or by means of the pressure element.

Some stroke patients are unable to move their tibialis anterior muscle or dorsal extensor, which in some cases can lead to so-called foot drop. In order to help the patient lift their foot it has therefore proven to be advantageous if the adjustment unit comprises a supporting carrier connected at one end to the main carrier and at the other end, rotatably or non-rotatably, to the foot receiving portion. The foot receiving portion and/or the supporting carrier is thereby associated with an actuator by means of which the foot receiving portion and/or the supporting carrier are adjustable relative to the main carrier between a raised position and a lowered position. The adjustment can be made gradually or continuously. For a smooth raising and lowering of the forefoot, however, a continuous adjustment is preferred. When the foot receiving portion is non-rotatably connected to the supporting carrier, the foot receiving portion can receive the toe of the foot such that the foot can be inclined due to the elasticity of the toe of the foot. Although the preferably releasable connection of the toe of the shoe is configured with the foot receiving portion, the toe—as in a cross-country ski binding—can be elastically deformed. By this elastic toe of the foot, a tilting or a pivoting of the sole of the foot with respect to the supporting carrier can be achieved. In a non-rotatable coupling of the foot receiving portion with the supporting carrier, these two components can also be formed in one piece as foot supporting carriers.

The actuator can also be provided with an actuator drive for the motor-driven adjustment of the foot receiving portion and/or the supporting carrier. In this embodiment, an actuator drive formed by an electric motor is preferably realized, which can adjust the supporting carrier and/or the foot receiving portion between a raised position and a lowered position. In other words, the actuator acts as a foot lifter. In a healthy person, this task is carried out by the tibialis anterior muscle.

In this context, it has been found useful when the traction element or the pressure element is coupled to or can be coupled to the actuator, that the foot receiving portion and/or the supporting carrier are adjustable between the raised and lowered position by actuating the actuator by means of the traction element or by means of the pressure element, and that the main carrier can be pushed, pulled or pressed in and/or counter to the adjustment direction by actuating the actuator by means of the traction element or by means of the pressure element. The actuator can thus perform two different tasks simultaneously, namely on the one hand that of a foot lifter, in particular a forefoot lifter, and on the other hand that of the forward movement of the entire therapeutic walking trainer during the swinging leg phase.

A simple mechanical structure can be achieved in that the actuator is connected in an articulated manner to the main carrier and in that the actuator is assigned a control element which interacts with a control cam provided on the foot receiving portion and/or on the supporting carrier. In this case, the foot receiving portion and/or the supporting carrier are adjustable by adjusting the control element relative to the control cam between the raised and lowered positions.

The actuator can be designed as a rocker arm which is pivotably mounted on the main carrier, which by pivoting can adjust the foot receiving portion and/or the supporting carrier between the raised position and the lowered position. This has the advantage that a traction element or a pressure element can act on the rocker arm with a force by means of which the natural lifting movement of the foot can be simulated.

It has proven advantageous if one or more measuring sensors are assigned to the supporting carrier and/or the foot receiving portion. This measuring sensor is designed, for example, as an inclination sensor. If the inclination sensor is associated with the supporting carrier, the inclination of the supporting carrier with respect to the main carrier arranged on the walking surface can be detected and documented by a control computer. Additionally, or alternatively, the inclination sensor can be attached to the foot receiving portion so that its inclination with respect to the supporting carrier is measurable and documented by the control computer. In both cases, a display device can provide the user with feedback about the values detected by the measuring sensor (biofeedback).

Furthermore, it has proven advantageous if the measuring sensor is designed as a torsion sensor that detects the torsion of the supporting carrier and/or the foot receiving portion. This way, it can be determined whether the user is directionally stable, i.e., whether the latter is walking in a straight line.

Furthermore, a strain sensor (DMS) can be provided on the supporting carrier and/or the foot receiving portion. This allows for the strain of the individual components to be detected.

The main carrier can be mounted in a rail, for example in a sliding rail. The adjustment direction of the therapeutic walking trainer can be determined by the rail profile.

A preferred stationary embodiment of the therapeutic walking trainer is characterized in that the foot receiving portion is mounted slidably relative to the at least one main carrier in such a way that a lateral displacement of the foot or the toe of the user's shoe relative to the adjustment direction is made possible. During everyday walking, a normal healthy person uses a slight lateral variation in the placement of the foot so as to maintain postural control (balance) optimally upright. This embodiment is provided because thereby, the user's or patient's foot can be displaced laterally by a few centimeters during the swinging leg phase.

In order to limit the range of motion of the lateral displacement, a further development provides that a limiting unit is provided, which is adapted to enable limited lateral deflection of the user's foot or toe of the shoe. To this end, the limiting unit can include stop elements which limit lateral mobility of the foot to about 20 cm, preferably to about 10 cm, further preferably to about 5 cm.

In order to prevent falls, an alternative therapeutic walking trainer is characterized in that a holder is provided which comprises a harness system. In one embodiment, the harness system is designed so as to protect the user from falls. Alternatively, or additionally, the harness system is configured to relieve a portion of the person's body weight (partial weight relief), which means that the user's legs have to take on less weight. The holder is preferably formed of a vertical part, a horizontal part, and a bent section connecting the vertical part to the horizontal part. As a result, a falling user can be caught or intercepted from above.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
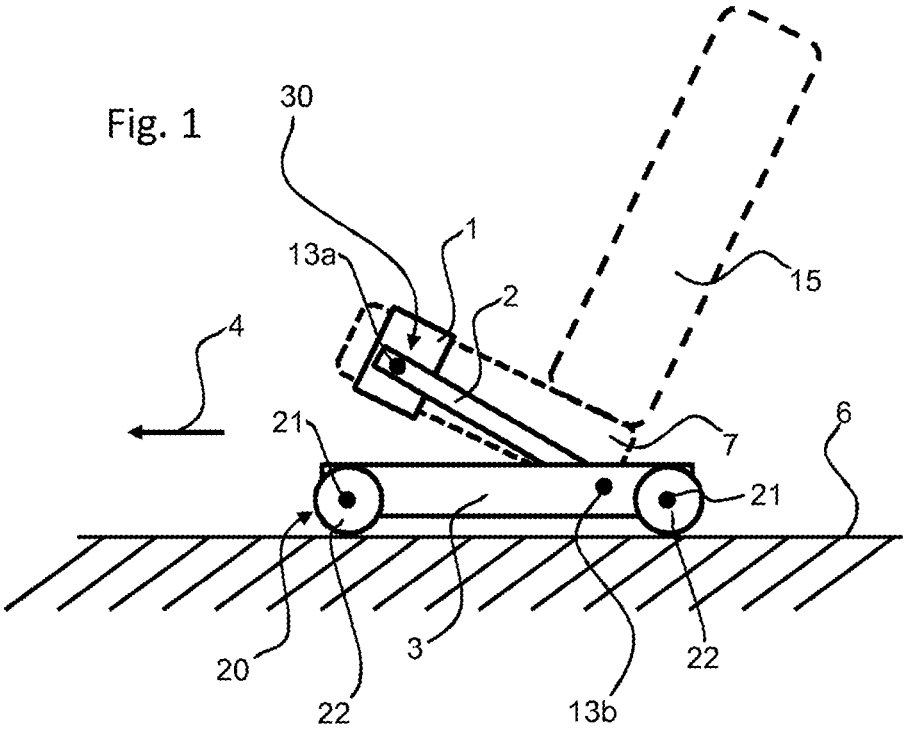
FIG. 1 is a side view of a mobile therapeutic walking trainer.

In the figures, several therapeutic walking trainers are shown which comprise a foot receiving portion 1 for receiving a sub-region of the forefoot of a user or for forming a preferably releasable connection with the toe of a shoe. Furthermore, at least one main carrier 3 which can be displaced in and/or counter to an adjustment direction 4 is provided.

In addition, the therapeutic walking trainers include an actively and/or passively operable adjustment unit 30 for the relative adjustment, oriented substantially perpendicular to the adjustment direction 4, of said foot receiving portion 1 relative to the at least one main carrier 3.

In the walking trainers according to FIGS. 1 to 10, the adjustment unit 30 comprises a supporting carrier 2. These supporting carriers 2 are either pivotally connected to the foot receiving portion 1 or arranged in a rotationally fixed manner relative to the latter. In particular in those cases in which a toe of a shoe is coupled to the foot receiving portion 1 in accordance with the principle of a cross-country ski binding, the supporting carrier 2 is preferably mounted rotationally fixed relative to the foot receiving portion 1.

In both cases, however, the supporting carrier 2 is pivotally connected at the other end to a main carrier 3, wherein the main carrier 3 is adjustable or displaceable in and/or counter to an adjustment direction 4.

If the foot receiving portion 1 is pivotally arranged relative to the supporting carrier 2, a first pivot joint 12 (supporting carrier-foot receiving portion joint) is provided between the supporting carrier 2 and the foot receiving portion 1, by means of which a rotation of the foot receiving portion 1 against the supporting carrier 2 is possible about an axis 13*a* arranged substantially perpendicular to the adjustment direction 4. In an inexpensive version of the walking trainer, a pin bearing is provided as a pivotal connection between the supporting carrier 2 and the foot receiving portion 1.

Furthermore, the pivotal connection between the supporting carrier 2 and the main carrier 3 is provided so that the supporting carrier 2 is pivotally mounted relative to the main carrier 3. In this case, a second pivot joint 14 (supporting carrier-main carrier pivot joint) is provided, which is also rotatable about an axis 13*b* oriented substantially perpendicular to the adjustment direction 4. Here, a pin bearing is also provided in an inexpensive embodiment.

Figure 2:
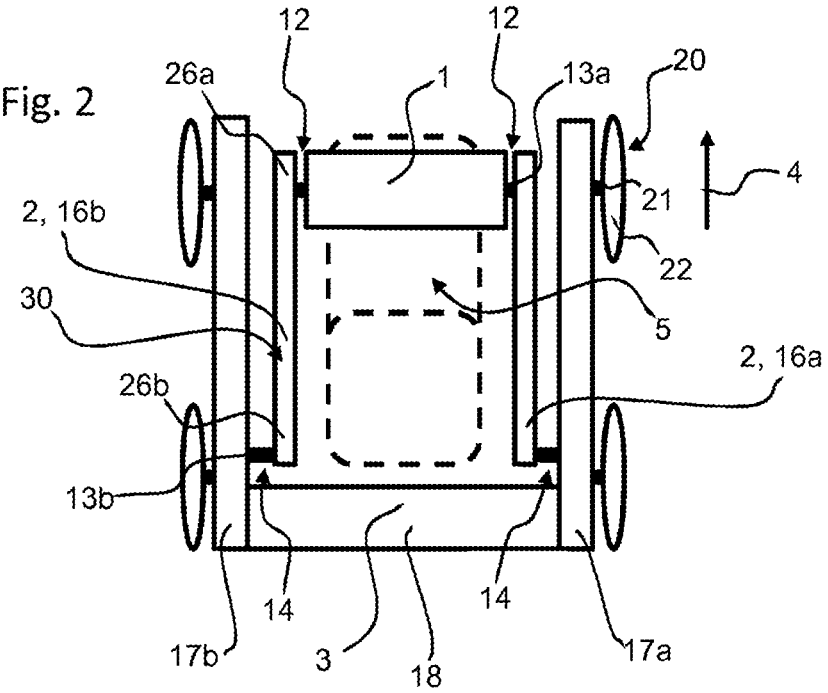
FIG. 2 is a possible plan view of the therapeutic walking trainer of FIG. 1.

As can be seen in particular from the plan view of the mobile version of a therapeutic walking trainer in FIG. 2, a free space 5 is formed on the main carrier 3 which is designed in such a way that the walking surface 6 or the floor is accessible to at least part of the foot 7 of a user. The lower leg 15 and the foot 6 of a user are shown in broken lines in all figures. As can be seen from FIG. 2, the foot receiving portion 1 is arranged centrally for receiving at least a sub-region of the forefoot of a user. In the present case, this foot receiving portion 1 is pivotably mounted between a plurality of supporting carriers 2, namely a first supporting carrier 16*a* (on the right side of the foot receiving portion 1) and a second supporting carrier 16*b* arranged on the side of the foot receiving portion 1 opposite the first supporting carrier 16*a* (on the left side of the foot receiving portion 1). The first supporting carrier 16*a*, which is arranged in the adjustment direction 4 on the right side of the user foot, is in turn pivotally connected to a first longitudinal beam 17*a*. The second supporting carrier 16*b* is arranged on the left side of the foot 7 in the adjustment direction 4, and in turn pivotally connected to the second longitudinal beam 17*b*. Further, the first longitudinal beam 17*a* and the second longitudinal beam 17*b* are coupled by a cross beam, in particular a rear cross beam 18, so that overall a U-shaped main carrier 3 is produced. In another embodiment, the cross beam is disposed on the side of the therapeutic walking trainer facing the foot receiving portion 1 and the longitudinal beams 17*a*, 17*b*, so that the former then forms the U-shaped main carrier 3 as the front cross beam 19.

To drive the main carrier 3 forward, on the one hand a drive may be provided by means of which the main carrier 3 and thus the entire therapeutic walking trainer can be adjusted or displaced by a motor. Alternatively, however, a pressure element, for example a push rod on the base frame, can engage in particular on the rear cross beam 18 so as to push the therapeutic walking trainer in the adjustment direction 4 or pull it counter to the adjustment direction 4.

As is apparent from the figures, in the present case rollers 20 are attached to the main carrier 3, by means of which the therapeutic walking trainer is displaceable or adjustable in and/or counter to the adjustment direction 4. In the present case, the rollers 20 are formed by wheels 21 arranged on axes 22 which are connected to the main carrier 3. An alternative embodiment provides that individual wheels 22, preferably even all of the wheels 22, can be driven by the drive. In the present case, exactly four rollers 20 are provided, wherein another number is possible as well. Instead of wheels 22, other sliding elements can also be provided, by means of which the therapeutic walking trainer is adjustable in and/or counter to the adjustment direction 4.

Figure 3A:
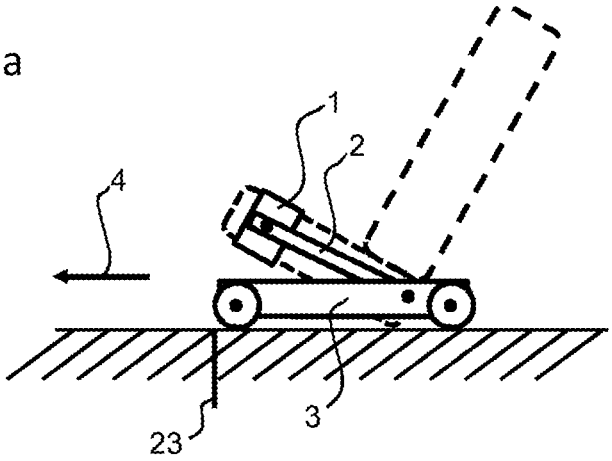
FIG. 3*a* shows the therapeutic walking trainer according to FIG. 1 in a touching down/landing configuration (standing leg phase)
Figure 3B:
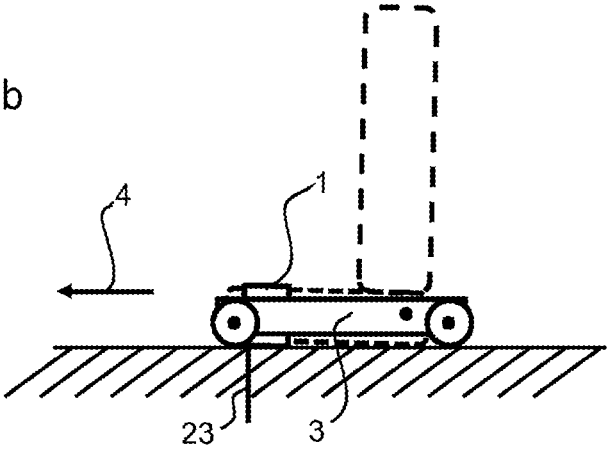
FIG. 3*b* shows the therapeutic walking trainer according to FIG. 1 in a standing configuration (standing leg phase)
Figure 3C:
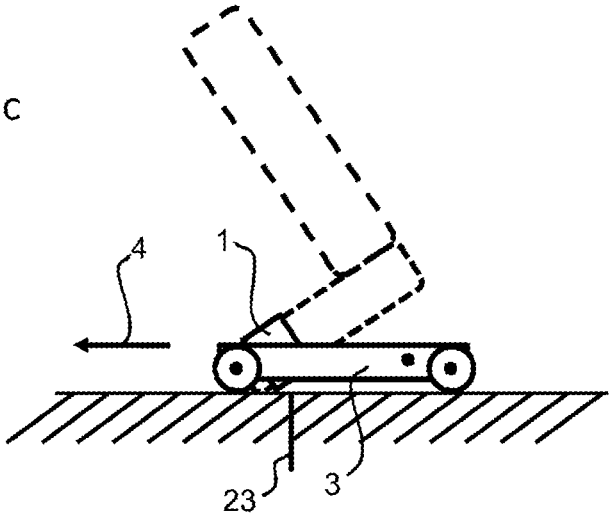
FIG. 3*c* shows the therapeutic walking trainer according to FIG. 1 in a push-off configuration (standing leg phase)
Figure 3D:
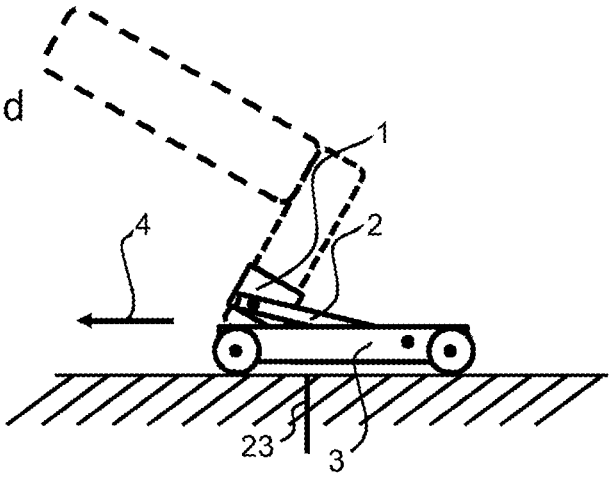
FIG. 3*d* shows the therapeutic walking trainer according to FIG. 1 in a configuration of the early swinging leg phase (swinging leg phase)
Figure 3E:
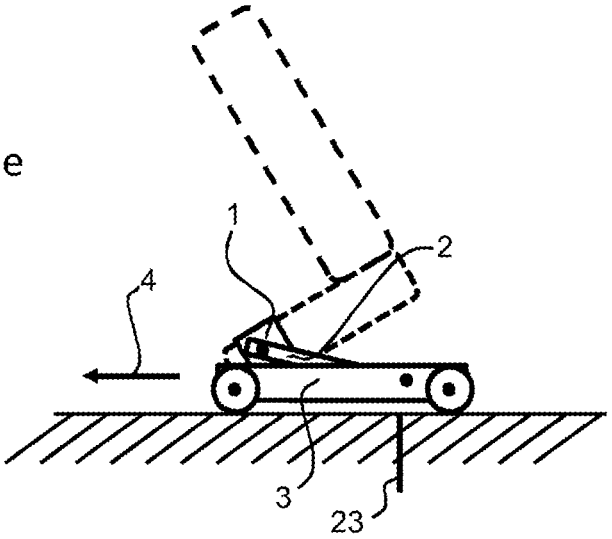
FIG. 3*e* shows the therapeutic walking trainer according to FIG. 1 in a configuration of the middle swinging leg phase (swinging leg phase)
Figure 3F:
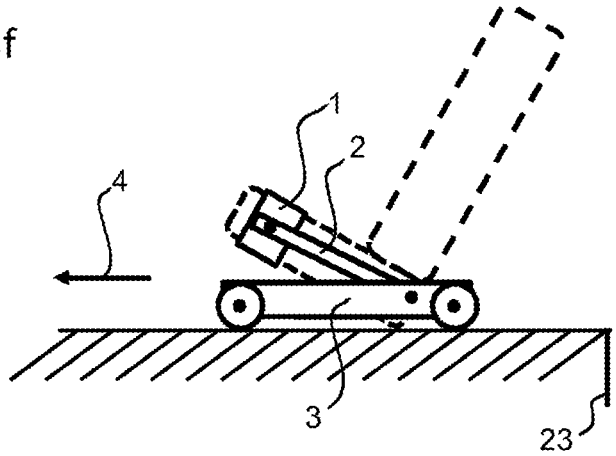
FIG. 3*f* shows the therapeutic walking trainer according to FIG. 1 in a configuration at the end of the final swinging leg phase (swinging leg phase)

The mode of operation of all of the present therapeutic walking trainers is intended to be explained in more detail by FIGS. 3*a* to 3*f*. In order to show that the therapeutic walking trainer is displaced on the walking surface 6, a marking 23 is provided. FIGS. 3*a* to 3*c* show configurations (or positions) of the walking trainer during the standing leg phase and FIGS. 3*d* to 3*f* show configurations (or positions) of the walking trainer during the swinging leg phase.

First, the heel of the user reaches the floor or the walking surface 6 (FIG. 3*a*) without a weight load. In the view from the left, the foot receiving portion 1 pivots slightly clockwise relative to the supporting carrier 2. Then, the leg shown takes over the load, wherein the sole of the user comes into contact with the ground (FIG. 3*b*). Here, in the view from the left, counter to the clockwise direction, the supporting carrier 2 is pivoted with respect to the main carrier 3 such that it is oriented substantially parallel thereto. In the middle standing phase, the foot 7 of the user is approximately underneath the body center of gravity and the entire body weight acts on the leg. In a healthy user, the calf muscle propels the body, wherein in synchronism with the body's forward shift, a rolling movement takes place on the foot 7 until the push-off phase is reached (FIG. 3*c*). This forward movement is supported by the displaceable or adjustable main carrier 3.

The standing leg phase is followed by the swinging leg phase, which begins with the lifting of the leg after the standing leg phase. The thigh is raised by the hip flexors of the user and the lower leg by the knee flexors of the user, wherein the foot 7 initially remains passive (FIG. 3*d*). In this configuration—in the left view—the foot receiving portion 1 is pivoted in the counterclockwise direction relative to the supporting carrier 2. The supporting carrier 1 is in turn pivoted clockwise relative to the main carrier 3. In a powered version, both pivotal movements can also be motorized.

In the middle swinging leg phase, the leg is displaced forward by the increased hip flexion, while the knee is angled approximately 90 degrees (FIG. 3*e*). In FIG. 3*e*, the foot receiving portion 1 is again pivoted back clockwise against the supporting carrier 2. In addition, the toes and the foot 7 are actively raised in the middle swinging leg phase, which can be achieved in the present case by pivoting the supporting carrier 2 relative to the main carrier

3. In this configuration, the foot 7 can be guided with distance from the walking surface 6 to the front, that is to say in the direction of the adjustment direction 4. In other words, the therapeutic walking trainer supports the foot 7 of the user with a suitable "trajectory". In this phase, flexion in the hip joint is also the greatest.

In the final swinging leg phase, the leg is again lowered in the direction of the walking surface 6, wherein the knee is actively stretched and the foot 7 is held in the neutral position (FIG. 3*f*). The supporting carrier 2 pivotally mounted on the main carrier 3 supports the foot 7 of the user in the forthcoming contact of the heel with the ground, so that the heel does not hit the walking surface 6 too hard.

The therapeutic walking trainer supports the foot 7 of the user in every single phase, so that an almost natural gait cycle can be achieved with the walking trainer.

Figure 4:
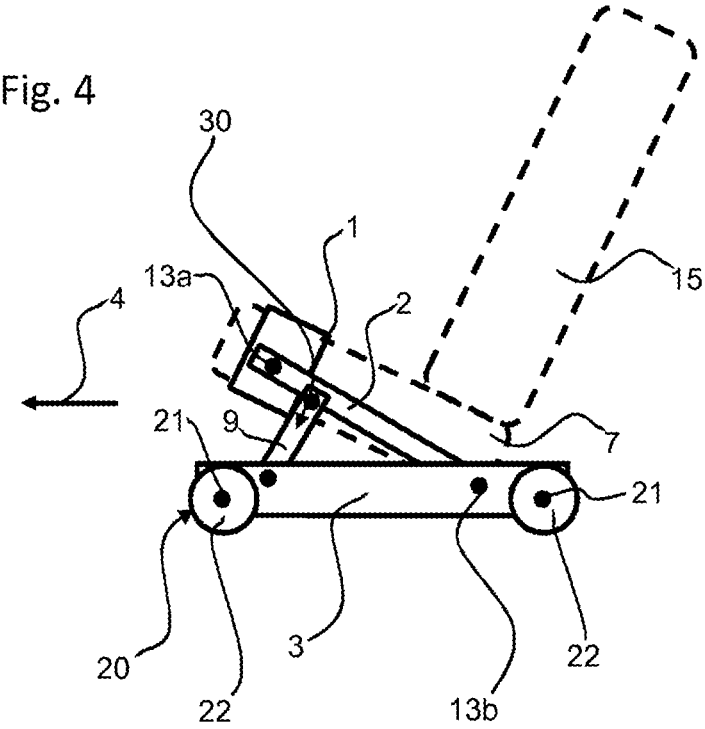
FIG. 4 shows a further mobile therapeutic walking trainer with an actuator, shown in a side view.

FIG. 4 shows a further embodiment of a mobile therapeutic walking trainer, wherein in this embodiment, an actuator 9 is provided, by means of which the supporting carrier 2 can be pivoted relative to the main carrier 3. This actuator 9 allows for a continuous adjustment of the supporting carrier 2 and hence of the foot receiving portion 1 against the main carrier 3 between a raised position (see FIG. 3*a*) and a lowered position (see FIG. 3*b*).

In the present case, the actuator 9 is pivotally mounted on the main carrier 3, in particular on the longitudinal beams 17*a*, 17*b*. Furthermore, a control element 10 is formed on the actuator 9, which is movable along a surface or a control cam 11 on the supporting carrier 2. By means of the control element 10 sliding along the control cam 11, the supporting carrier 2 and thus the foot receiving portion 1 can be raised or lowered.

Figure 6:
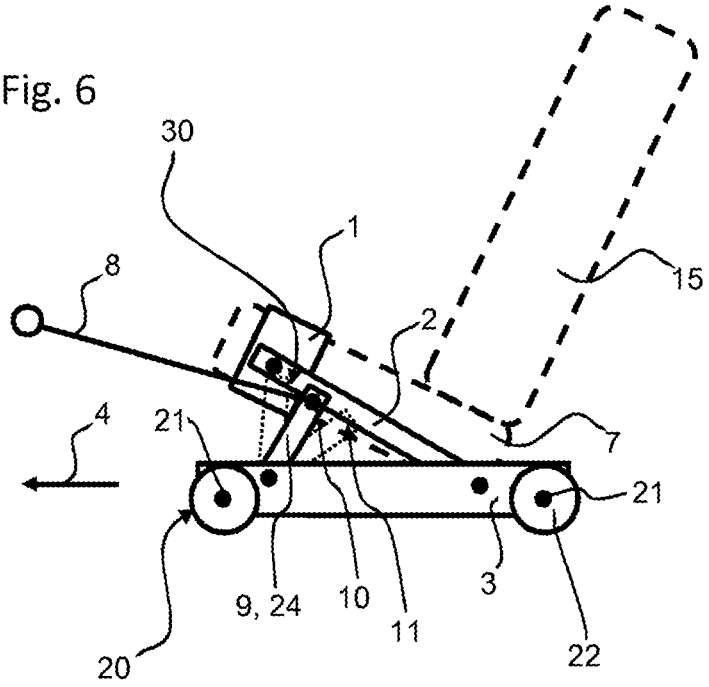
FIG. 6 shows a side view of the walking trainer according to FIG. 4, which is supplemented with a traction element.

A traction element 8 can be provided to raise or lower the user's forefoot, as is shown for example in FIG. 6. Here, the traction element 8 engages on the actuator 9 in the area of the control element 10. The actuator 9, which is formed as a rocker arm 24, can be pivoted by means of a tensile force which does not act parallel to the longitudinal direction. In addition to a horizontal force component, this pivoting movement at the same time provides a vertical force component by means of which the supporting carrier 2 and thus the foot receiving portion 1 can be lifted. The horizontal force component causes the main carrier 3 to be displaced in and/or counter to the adjustment direction 4. Alternatively, or additionally, in addition to the illustrated traction element 8, a further second traction element can be used by means of which the main carrier 3 is adjustable along the walking surface 6 separately from the (vertical) traction element acting on the actuator 9. In other words, the traction element 9 then serves to actuate the actuator 9 (actuator traction element) and the second traction element serves to adjust or displace the main carrier 3.

Figure 5:
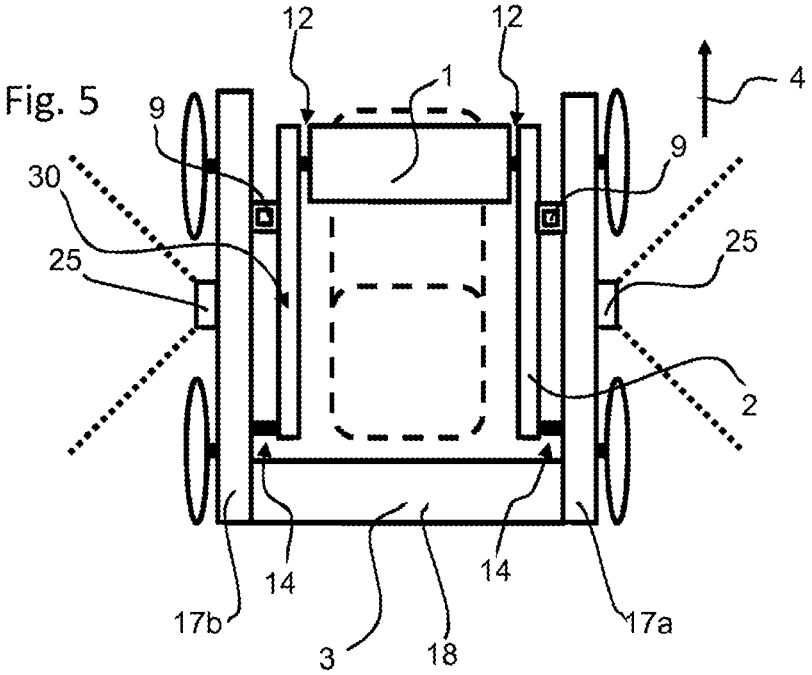
FIG. 5 shows a plan view of the walking trainer according to FIG. 4, which is supplemented with sensors.

FIG. 5 shows a further embodiment of a mobile therapeutic walking trainer, which basically has the same structure as the one shown in FIG. 4. Here, too, actuators 9 are provided for the adjustment of the supporting carriers 2 and thus of the foot receiving portion 1. In addition—schematically illustrated—at least one, preferably a plurality of sensors 25 are provided for detecting the position of the adjacent, preferably free, foot. In the present case, the sensors 25 are formed as optical camera systems by means of which the position of the adjacent leg or foot can be detected. The main carrier 3 is used here as a housing for the sensors 25 so that the sensors 25 in other words are received in the main carrier 3. Depending on the position of the adjacent leg, the therapeutic walking trainer can be displaced in accordance with the current walking phase by an intelligent logic and/or controller. Furthermore, the (height) position of the foot receiving portion 1 can be varied and adjusted by a higher-level control computer in dependence on the position of the adjacent leg in the swinging leg phase.

Figure 7:
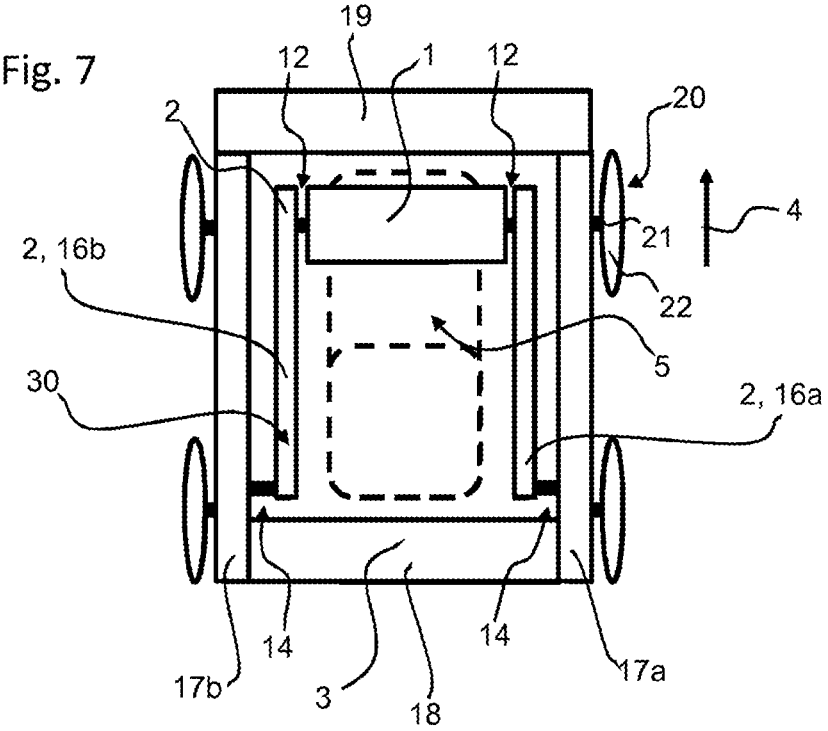
FIG. 7 shows a further mobile therapeutic walking trainer, shown in a plan view.

FIG. 7 shows a further embodiment of a mobile therapeutic walking trainer corresponding substantially to the one described in FIG. 2. This one, however, is supplemented by a front cross beam 19, so that overall a frame-shaped main carrier 3 is created which has a respective free space 5 for the passage of a foot 7. In this embodiment, the foot 7 of the user is protected all around by the frame-shaped main carrier 3.

Figure 8:
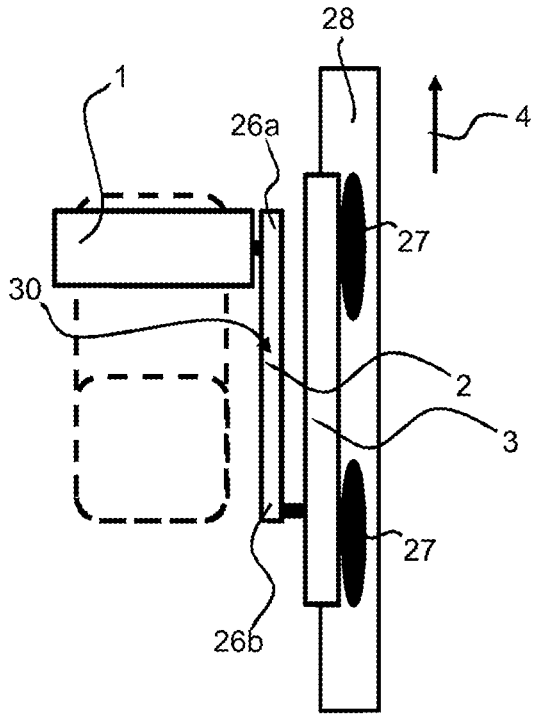
FIG. 8 shows a further stationary embodiment of a therapeutic walking trainer guided in a rail.
Figure 9:
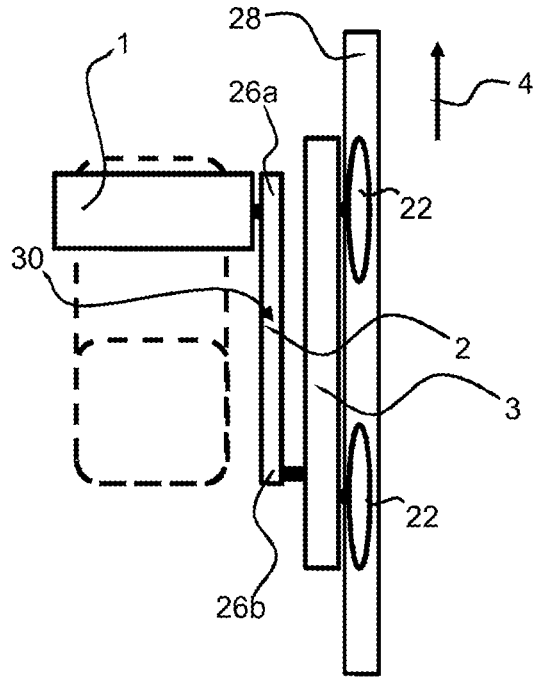
FIG. 9 shows an alternative stationary embodiment of the therapeutic walking trainer according to FIG. 8, guided in a rail.

FIG. 8 shows a further therapeutic gait trainer which can be operated in a stationary manner, which has a foot receiving portion 1 arranged on a first end 26*a* of a supporting carrier 2 in a hingedly connected or pivotable manner. At the second end 26*b* of the supporting carrier 2, a main carrier 3 is arranged in a hingedly connected or pivotable manner, as was also the case in the previous exemplary embodiments. Notwithstanding, in this walking trainer it is provided that the main carrier 3 now has sliding elements 27 which in turn are guided in a guide rail 28.

Instead of sliding elements 27, wheels 22, in particular powered wheels 22, can also be used to adjust or displace the therapeutic walking trainer in the guide rail 28 in and/or counter to the adjustment direction 4. This can be seen in the walking trainer according to FIG. 9.

Figure 10:
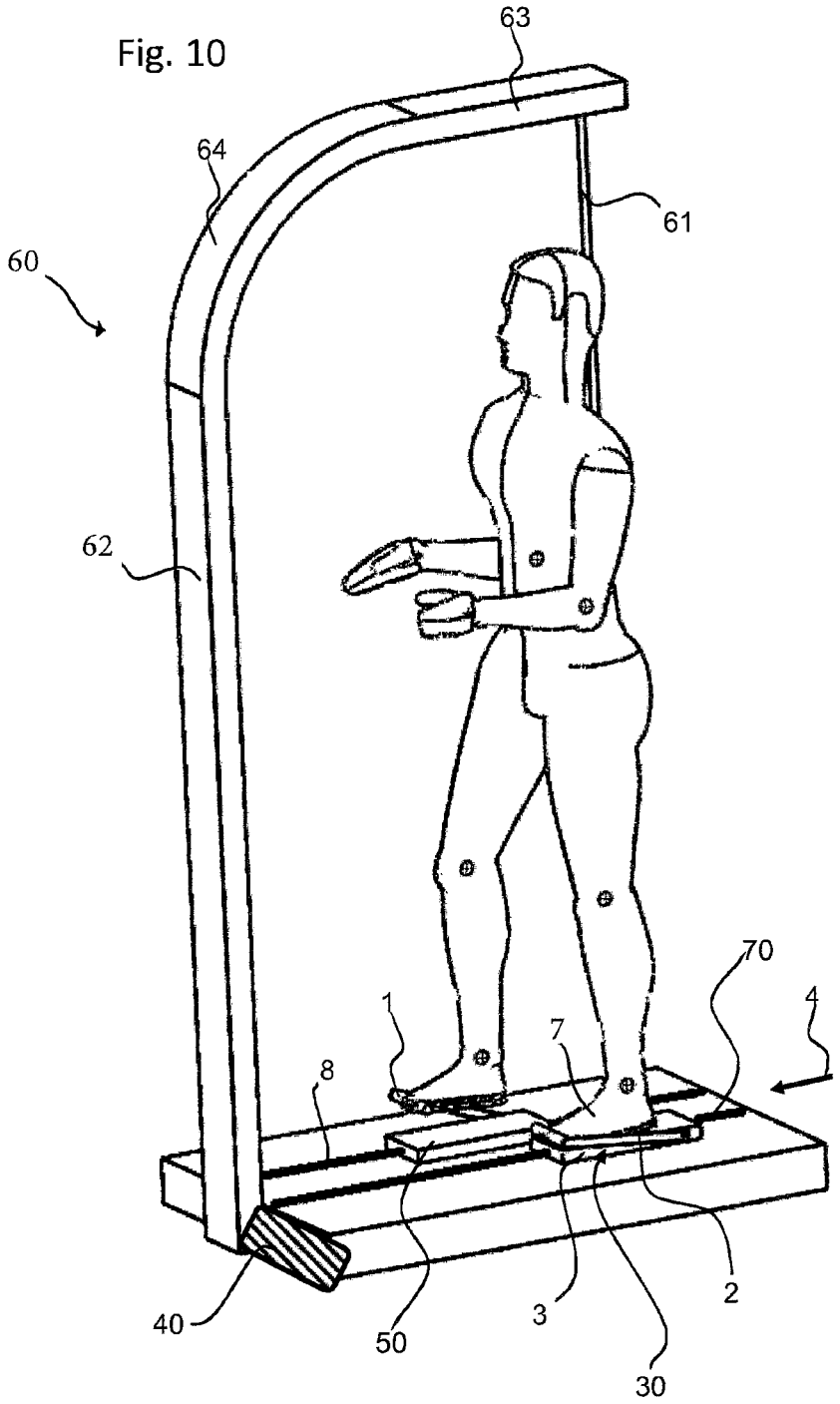
FIG. 10 shows a further stationary embodiment of a therapeutic walking trainer.
Figure 10A:
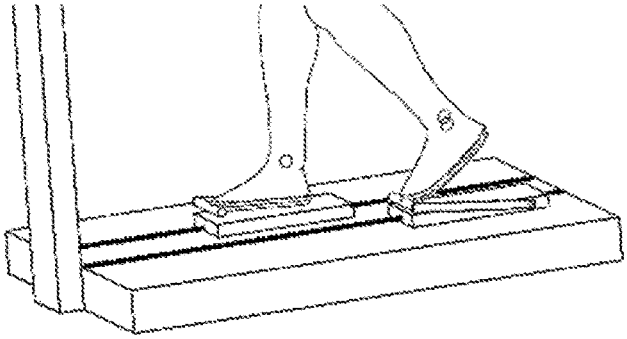
FIGS. 10*a*-10*f* show a section of the therapeutic walking trainer from FIG. 10 in different positions (foot positions of the user)
Figure 10B:
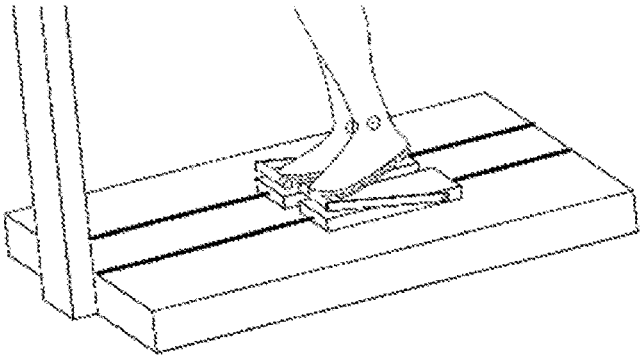
Figure 10C:
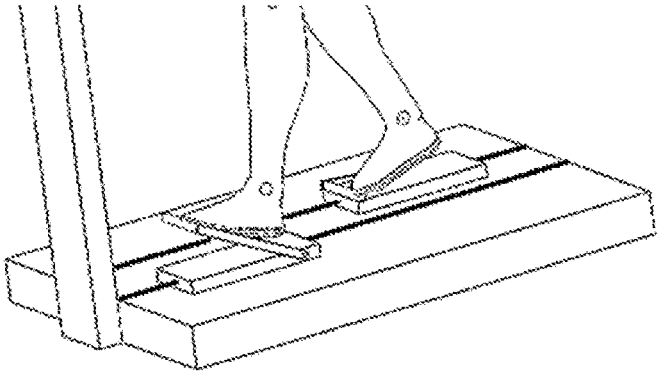
Figure 10D:
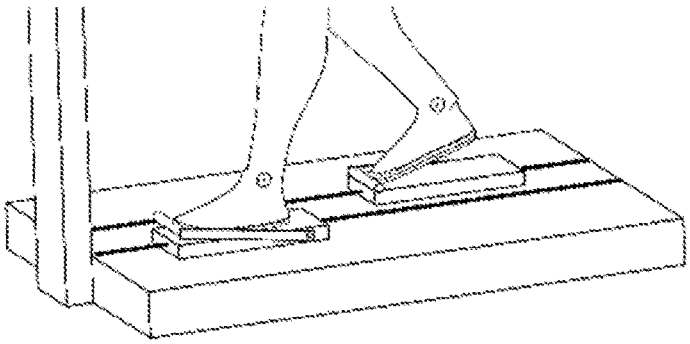
Figure 10E:
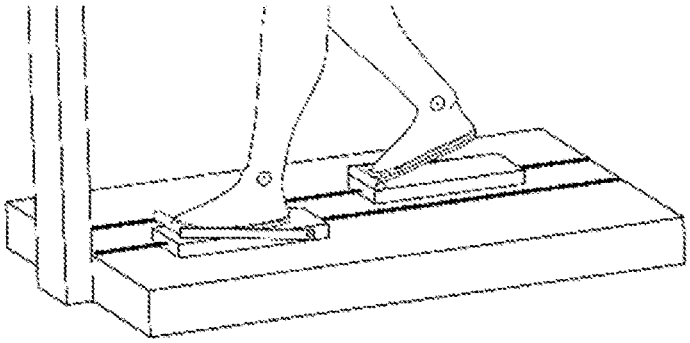
Figure 10F:
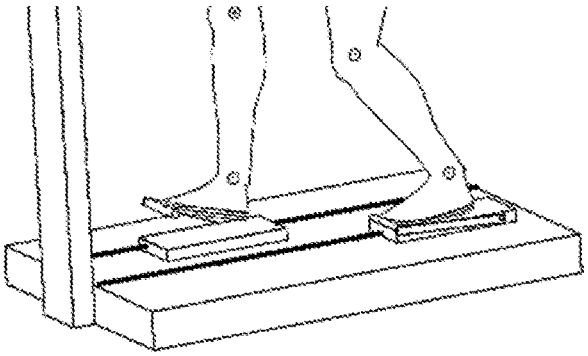

FIG. 10 shows a preferred embodiment of the therapeutic walking trainer according to the invention with an actively and/or passively operated adjustment unit 30 for the relative adjustment, oriented essentially perpendicular to the adjustment direction 4, of the foot receiving portion 1 relative to the at least one main carrier 3. In the present case, in each case a main carrier 3 is provided for each user foot. The main carriers 3 of this embodiment differ from those according to FIGS. 1 to 9 in that they have a tread surface 50, which is adapted so as to be tread on by the foot 7 of the user or by the shoe. In other words, the main carrier 3 according to FIG. 10 has no free space 5 and users can stand on the main carrier 3 itself. Here, a supporting carrier 2 is also attached to the main carrier 3 in a hingedly connected manner at a rear first end. The other end of the supporting carrier 2 is either pivotally or non-rotatably coupled to the foot receiving portion 1, so that the connection of the foot receiving portion 1 to the supporting carrier or carriers 2 is carried out analogously to the walking trainers discussed above. In the present case, the main carriers 3 are guided in rails 70 or in a slotted guide. Alternatively, or additionally, the traction element 8 can be guided in the rail 70, for example, as a chain, as a toothed belt, by means of gear wheels, with a cable pull or the like. The traction element 8 is effective between the schematically indicated drive 40 and the respective main carrier 3. In other words, the traction elements 8 drive the main carrier 3 by motor in and/or counter to the adjustment direction 4. The embodiment also has a holder 60 formed of a vertical part 62 and a horizontal part 63 with a harness system 61. The vertical part 62 and the horizontal part 63 are connected to each other by a bent section 64. The harness system 61 fastened to the horizontal part 63 serves to hold the user and prevents the latter from falling. For this purpose, the bent section provides a spring force, so that a falling user is braked by the spring-mounted horizontal part 63 and gently caught by the harness system 61. Preferably, the harness system 61 is not "tensioned" when the therapeutic walking trainer is being walked on, but only becomes effective in the event of a fall. It therefore does not hinder the natural gait cycle carried out on the walking trainer. The foot receiving portions 1 according to FIG. 10 can additionally be mounted displaceably relative to each main carrier 3 in such a way that a displacement of the foot 7 or the toe of the user's shoe, which is lateral relative to the adjustment direction 4 and limited by a limiting unit, is made possible. To this end, for example, the foot receiving portion 1 might be associated with cylindrical tubes which can slide along a cylindrical pin. FIG. 10*a* to FIG. 10*f* show different foot or leg positions of the walking trainer according to FIG. 10.

Figure 11:
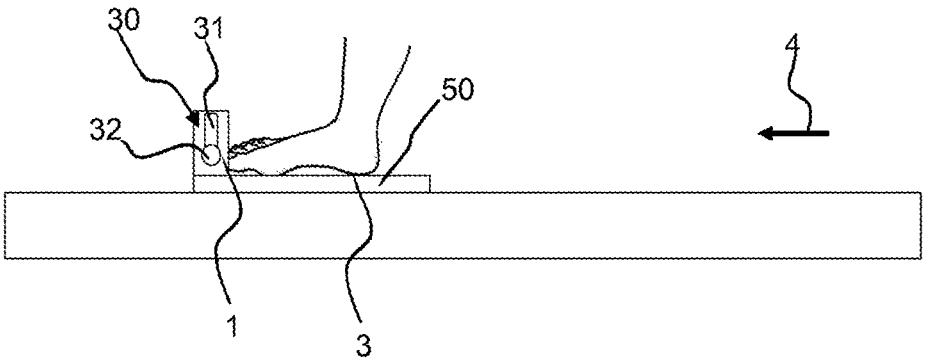
FIG. 11 shows a further stationary embodiment of a therapeutic walking trainer.
Figure 12A:
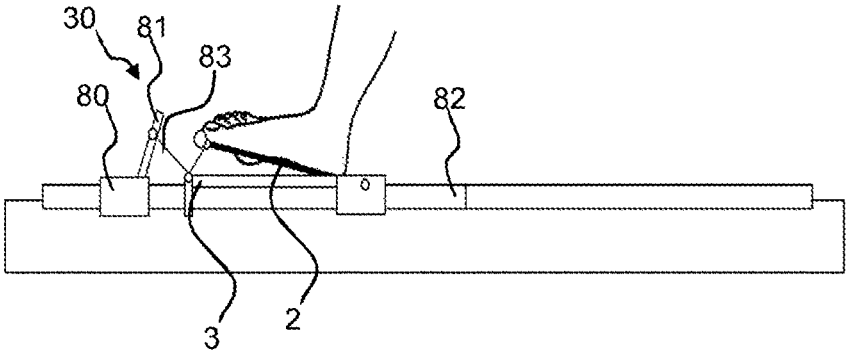
FIG. 12*a* shows a further stationary embodiment of a therapeutic walking trainer at the end of the swinging leg phase.
Figure 12B:
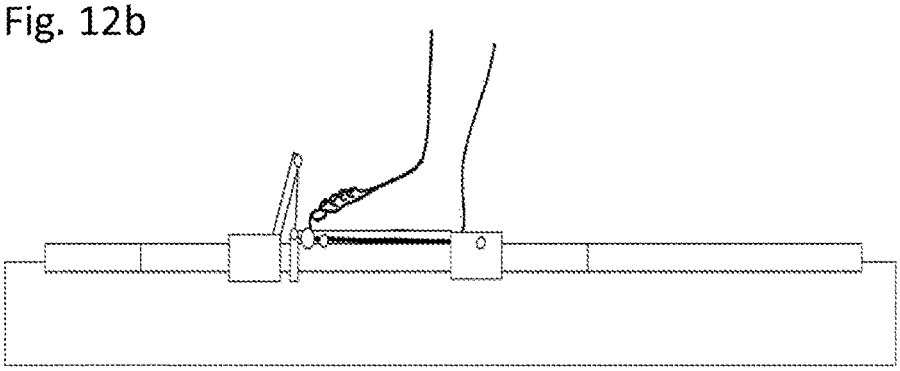
FIG. 12*b* shows the walking trainer from FIG. 12*a* during the standing phase.
Figure 12C:
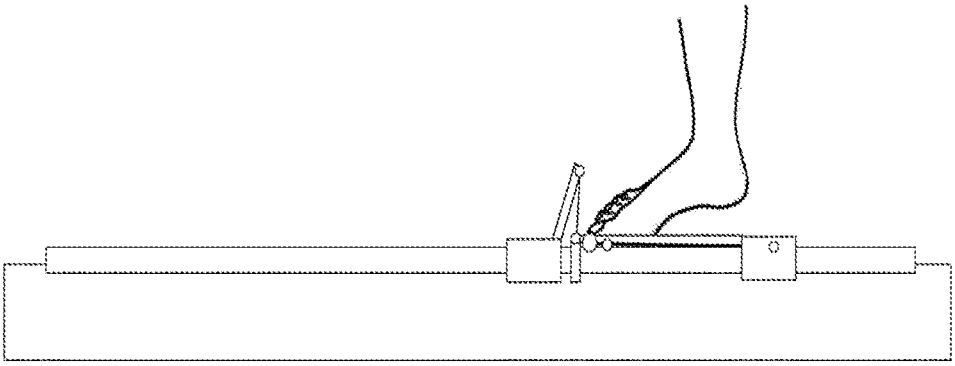
FIG. 12*c* shows the walking trainer from FIG. 12*a* during the push-off phase.
Figure 12D:
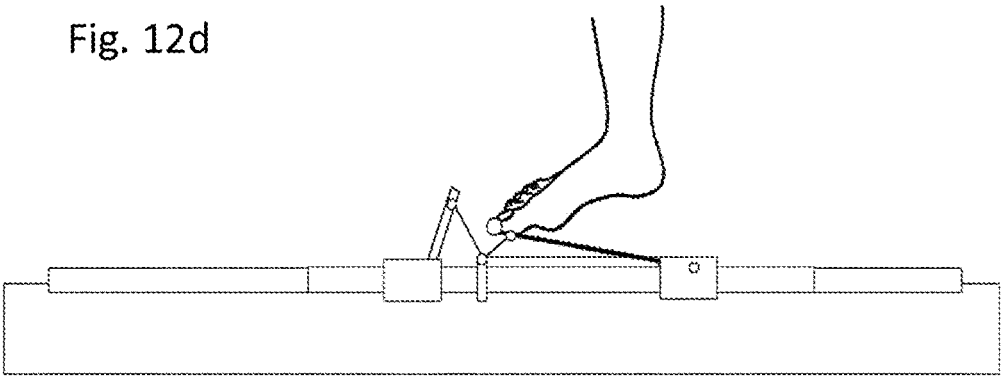
FIG. 12*d* shows the walking trainer from FIG. 12*a* during the swinging leg phase.

FIG. 11 shows a further therapeutic walking trainer with an adjustment unit 30 that can be adjusted vertically on the side of the toe of the user. Here too, the main carrier 3 is provided with a tread surface 50. However, the present walking trainer can do without a supporting carrier 2. Therefore, the adjustment unit 30 has a vertical guide 31 with a motor-operated actuator 32 which can adjust the foot receiving portion 1 relative to the main carrier 3 between a raised and a lowered position. This main carrier 3 with its adjustment unit 30 can be used in the device according to FIG. 10.

FIG. 12*a* to FIG. 12*d* shows a further embodiment of a therapeutic walking trainer, wherein the main carrier 3 is pivotally coupled to the supporting carrier 2 in the heel region. In addition, a linear motor 80 is provided, which is connected via a deflection lever 81 to the supporting carrier 2. The linear motor 80 can be displaced along the linear rail 82 in and/or counter to the adjustment direction 4. The deflection lever 81 ensures with a deflection wire 83 that the foot receiving portion 1 is lifted.

All walking trainers preferably have the property that the actuators and/or supporting units that support the natural gait cycle only intervene in those cases where the user actually requires support. That is, only then when the user alone is not able to provide the required action.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A therapeutic walking trainer comprising:

a foot receiving portion for receiving at least a sub-region of a of a user or for forming a connection with a toe of a shoe;

at least one main carrier that is adapted to be displaced in and/or counter to an adjustment direction; and an actively and/or passively operable adjustment unit for the adjustment of the foot receiving portion between a raised position and a lowered position relative to the at least one main carrier, wherein a top surface of the at least one main carrier, that faces the foot receiving portion, is a tread surface, and wherein, when the foot receiving portion is in the lowered position, a portion of the foot or the shoe of the user directly contacts and treads on the tread surface, and wherein, when the foot receiving portion is in the raised position, the portion of the foot or the shoe of the user is lifted off the tread surface, so as to be spaced apart from the tread surface; wherein the portion of the foot or the shoe of the user, that either directly contacts and treads on the tread surface or is spaced apart from the tread surface, is the forefoot of the user or the toe of the shoe.

2. The therapeutic walking trainer according to claim 1, further comprising a traction element or a pressure element.

3. The therapeutic walking trainer according to claim 2, wherein the foot receiving portion and/or a supporting carrier is associated with an actuator, via which the foot receiving portion and/or the supporting carrier are adjustable relative to the at least one main carrier between a raised position and a lowered position.

4. The therapeutic walking trainer according to claim 3, wherein the actuator is associated with an actuator drive for motorized adjustment of the foot receiving portion and/or the supporting carrier.

5. The therapeutic walking trainer according to claim 3, wherein the traction element or the pressure element is coupled to the actuator, wherein the foot receiving portion and/or the supporting carrier are adjustable by an actuation of the actuator via the traction element or via the pressure element, and wherein the at least one main carrier is adapted to be pushed, pulled or pressed in and/or counter to the adjustment direction by actuating the actuator via the traction element or via the pressure element.

6. The therapeutic walking trainer according to claim 3, wherein the actuator is pivotally connected to the at least one main carrier, wherein the actuator is associated with a control element which interacts with a control cam provided on a foot receiving portion and/or on the supporting carrier, and wherein the foot receiving portion and/or the supporting carrier are adjustable by adjusting the control element relative to the control cam.

7. The therapeutic walking trainer according to claim 2, wherein the adjustment unit comprises a supporting carrier which is pivotally connected at one end to the at least one main carrier, and at the other end non-rotatably or pivotally connected to the foot receiving portion, wherein the traction element or the pressure element is coupled with the supporting carrier such that the at least one main carrier is adapted to be pushed, pulled or pressed in and/or counter to the adjustment direction by actuating the supporting carrier via the traction element or via the pressure element.

8. The therapeutic walking trainer according to claim 2, wherein the traction element or the pressure element is coupled to the at least one main carrier such that the main carrier is adapted to be pushed, pulled or pressed in and/or counter to the adjustment direction.

9. The therapeutic walking trainer according to claim 1, wherein a holder is provided which comprises a harness system.

10. The therapeutic walking trainer according to claim 9, wherein the holder is formed of a vertical part, a horizontal part, and a bent section connecting the vertical part with the horizontal part.

11. The therapeutic walking trainer according to claim 1, wherein the at least one main carrier is associated with a drive that provides a motor-driven adjustment or displacement of the at least one main carrier in and/or counter to the adjustment direction.

12. The therapeutic walking trainer according to claim 1, wherein the adjustment unit comprises a supporting carrier, wherein a first end of the supporting carrier is pivotally connected to the at least one main carrier, and a second end of the supporting carrier is non-rotatably or pivotally connected to the foot receiving portion.

* * * * *